US010479637B2

(12) United States Patent
Morinaga et al.

(10) Patent No.: US 10,479,637 B2
(45) Date of Patent: Nov. 19, 2019

(54) BINDING TEETH, SHEET PROCESSING DEVICE, IMAGE FORMING APPARATUS, IMAGE FORMING SYSTEM, AND SHEET BINDING METHOD

(71) Applicants: Takuya Morinaga, Tokyo (JP); Nobuyoshi Suzuki, Tokyo (JP); Yuusuke Shibasaki, Kanagawa (JP); Wataru Takahashi, Tokyo (JP); Koki Sakano, Kanagawa (JP)

(72) Inventors: Takuya Morinaga, Tokyo (JP); Nobuyoshi Suzuki, Tokyo (JP); Yuusuke Shibasaki, Kanagawa (JP); Wataru Takahashi, Tokyo (JP); Koki Sakano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 33 days.

(21) Appl. No.: 15/357,671

(22) Filed: Nov. 21, 2016

(65) Prior Publication Data

US 2017/0174465 A1 Jun. 22, 2017

(30) Foreign Application Priority Data

Dec. 3, 2015 (JP) ..... 2015-236865

(51) Int. Cl.
*B65H 37/04* (2006.01)
*B31F 5/02* (2006.01)

(52) U.S. Cl.
CPC ..... *B65H 37/04* (2013.01); *B31F 5/02* (2013.01); *B65H 2301/51616* (2013.01); *B65H 2801/27* (2013.01)

(58) Field of Classification Search
CPC ..... B31F 5/02; B65H 2301/51616; B65H 2301/43828
See application file for complete search history.

(56) References Cited

U.S. PATENT DOCUMENTS

| | | | | |
|---|---|---|---|---|
| 8,596,633 | B2 * | 12/2013 | Awaya | B65H 37/04 270/58.07 |
| 2010/0202814 | A1 * | 8/2010 | Nakamura | B65H 37/04 399/408 |
| 2013/0264762 | A1 | 10/2013 | Matsushita et al. | |
| 2013/0300050 | A1 | 11/2013 | Suzuki et al. | |
| 2014/0138896 | A1 | 5/2014 | Yoshida et al. | |
| 2014/0219747 | A1 | 8/2014 | Takahashi et al. | |

(Continued)

FOREIGN PATENT DOCUMENTS

| | | | |
|---|---|---|---|
| JP | H06278933 | A | 10/1994 |
| JP | 2013032021 | A | 2/2013 |

(Continued)

OTHER PUBLICATIONS

Japanese Office Action; Application 2015-236865; dated Sep. 10, 2019.

*Primary Examiner* — Jennifer E Simmons
(74) *Attorney, Agent, or Firm* — Duft & Bornsen, PC

(57) ABSTRACT

A pair of binding teeth is configured to apply pressure to a sheet bundle to crimp-bind the sheet bundle. The pair of binding teeth includes a binding unit configured to have two or more binding areas which differ in tooth height and crimping portions thereof come in contact when the binding teeth are pressed against each other in the binding areas.

11 Claims, 8 Drawing Sheets

(56) References Cited

U.S. PATENT DOCUMENTS

| | | | | |
|---|---|---|---|---|
| 2015/0003938 | A1 | 1/2015 | Morinaga et al. | |
| 2015/0030414 | A1* | 1/2015 | Takahashi | B42C 13/00 412/33 |
| 2015/0076759 | A1 | 3/2015 | Kosuge et al. | |
| 2015/0091246 | A1 | 4/2015 | Yoshida et al. | |
| 2015/0093214 | A1 | 4/2015 | Takahashi et al. | |
| 2016/0107409 | A1* | 4/2016 | Kubo | B31F 1/07 412/33 |

FOREIGN PATENT DOCUMENTS

| | | | | |
|---|---|---|---|---|
| JP | 5361858 | B2 | | 12/2013 |
| JP | 2014-037309 | | | 2/2014 |
| JP | 2014037309 | A | * | 2/2014 |
| JP | 2014-162106 | | | 9/2014 |
| JP | 2014-168890 | | | 9/2014 |
| JP | 2014-177319 | | | 9/2014 |
| JP | 2016079000 | A | | 5/2016 |

* cited by examiner

BINDING TEETH, SHEET PROCESSING DEVICE, IMAGE FORMING APPARATUS, IMAGE FORMING SYSTEM, AND SHEET BINDING METHOD

CROSS-REFERENCE TO RELATED APPLICATIONS

The present application claims priority under 35 U.S.C. § 119 to Japanese Patent Application No. 2015-236865, filed Dec. 3, 2015. The contents of which are incorporated herein by reference in their entirety.

BACKGROUND OF THE INVENTION

1. Field of the Invention

The present invention relates to binding teeth, a sheet processing device, an image forming apparatus, an image forming system, and a sheet binding method.

2. Description of the Related Art

There are known binding devices using no metal staples in terms of the recent trend of resource conservation and recycling efficiency. As these kinds of devices, for example, a sheet processing device using a method of binding a bundle of sheets by applying pressure to the bundle of sheets from above and below, for example, with rugged teeth (crimp binding) has been disclosed in, for example, Japanese Unexamined Patent Application Publication No. 2014-168890 (Patent Literature 1) or Japanese Unexamined Patent Application Publication No. 2014-162106 (Patent Literature 2). Furthermore, there is already known a finisher equipped with both a binding unit using no metal staples (a staple-free binding unit) and a binding unit using metal staples (a staple-using binding unit).

Patent Literature 1 has disclosed, with the aim of selecting optimum binding teeth for each number of sheets to be bound and crimp-binding the bundle of sheets, a technology for a sheet processing device to hold two types of binding teeth that differ in height of ruggedness (tooth height) and switch between the binding teeth according to binding conditions, such as the number of sheets to be bound and the thickness of the sheets. Furthermore, Patent Literature 2 has disclosed, with the aim of reducing "twist" of a binding processing unit, a technology for binding teeth that the tooth width of around the ends thereof is shorter than that of around the center thereof and the tooth height of around the ends thereof is lower than that of around the center thereof.

However, in the technology disclosed in Patent Literature 1, the device holds two types of binding teeth, resulting in an increase in size. Furthermore, in the technology disclosed in Patent Literature 2, the binding force may decrease according to the number of sheets to be bound. Especially, in the technology disclosed in Patent Literature 1, the binding teeth differ in tooth height, and a gap between the binding teeth is wider at around the ends, and are not configured to engage with each other; therefore, although the binding teeth have the effect of reducing "twist", they are not intended to secure sufficient binding force at low-height portions. In either case, when a bundle of sheets is bound by crimp binding, there is a problem that the binding force varies according to the number of sheets to be bound, and decreases when the number of sheets to be bound is close to the upper and lower limit of a bindable sheet number.

SUMMARY OF THE INVENTION

According to one aspect of the present invention, there is provided a pair of binding teeth configured to apply pressure to a sheet bundle to crimp-bind the sheet bundle, including a binding unit configured to have two or more binding areas which differ in tooth height and crimping portions thereof come in contact when the binding teeth are pressed against each other in the binding areas.

According to another aspect of the present invention, there is provided a sheet binding method including: relatively positioning a sheet bundle between a pair of binding teeth including a binding unit configured to have two or more binding areas which differ in tooth height and crimping portions thereof come in contact when the binding teeth are pressed against each other in the binding areas; applying pressure in a direction of bringing the pair of binding teeth closer to each other in a state where the sheet bundle is placed between the pair of binding teeth; and binding the sheet bundle by pressing the sheet bundle firmly between the binding teeth.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
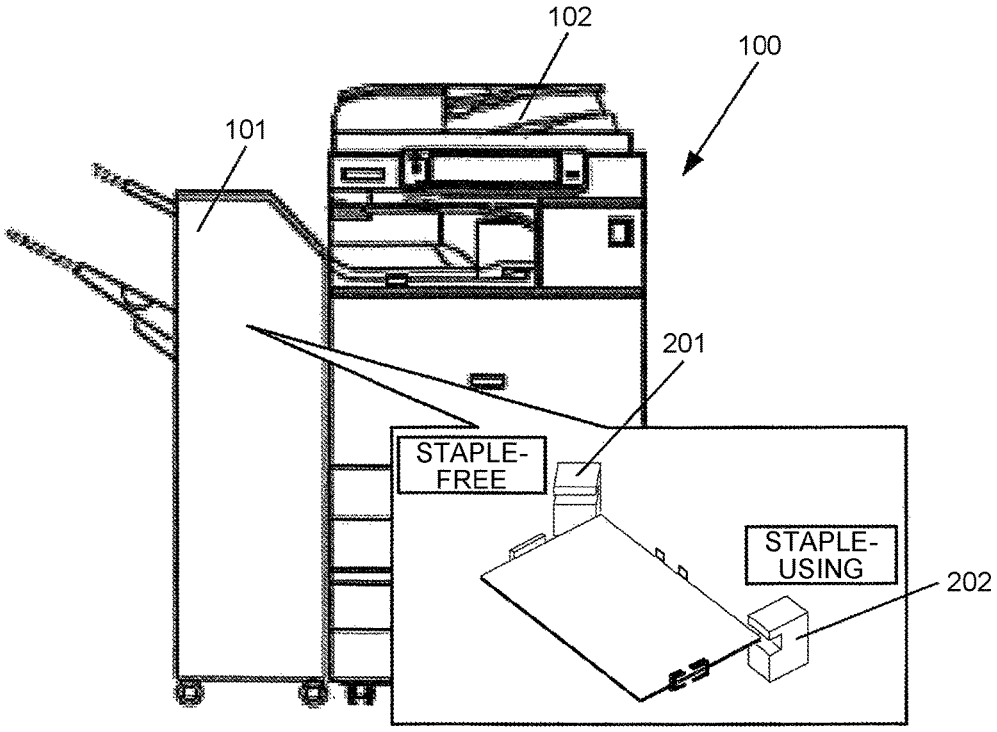
FIG. 1 is a diagram showing a system configuration of an image forming system according to an embodiment of the present invention.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

The present invention has an object to secure relatively uniform binding force regardless of the number of sheets to be bound and enough binding force to maintain the binding force, when crimp-binding a bundle of sheets.

The present invention is characterized in that binding teeth used for crimp binding each have multiple binding areas that differ in tooth height.

An exemplary embodiment of the present invention is described in detail below with reference to accompanying drawings.

FIG. 1 is a diagram showing a system configuration of an image forming system according to the embodiment of the present invention. In FIG. 1, an image forming system 100 is composed of a finisher 101 as a sheet processing device and an image forming apparatus 102. The finisher 101 is connected to the downstream side of the image forming apparatus 102 in a sheet conveying direction, thereby composing one system. The finisher 101 is equipped with both a staple-free binding unit 201 and a staple-using binding unit 202. The both are mechanically connected and are also electrically (controllably) connected; each unit of the finisher 101 is controlled by a control device of the image forming apparatus 102.

The image forming apparatus 102 includes, for example, an electrophotographic image forming engine, and forms an image on a sheet supplied by the image forming apparatus 102 itself or from the outside on the basis of input image information and then conveys the sheet with the image formed to the finisher 101 side.

Figure 2:
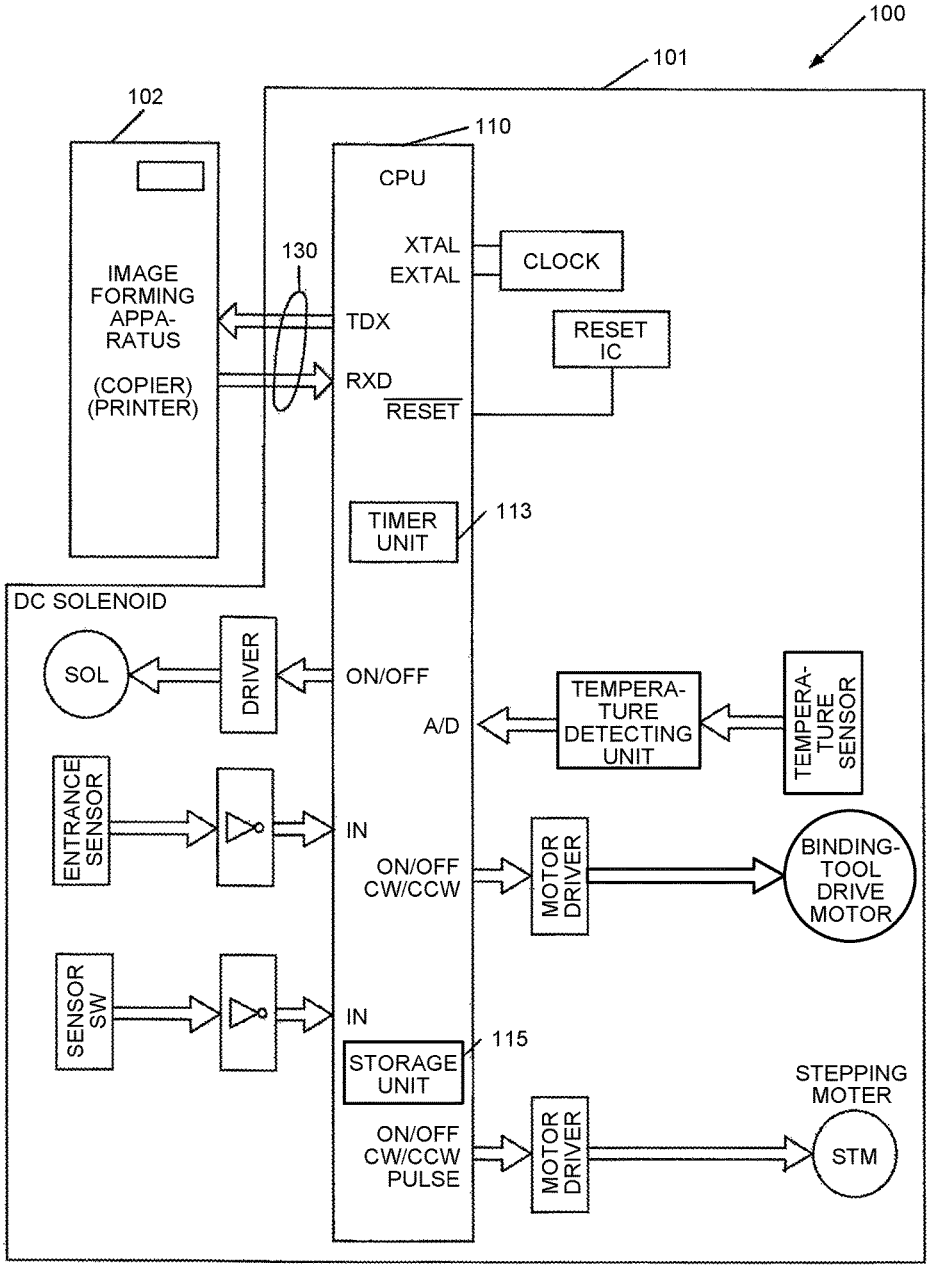
FIG. 2 is a block diagram showing an electrical system configuration of the image forming system in the present embodiment.

Incidentally, as respective internal mechanical configurations of the finisher 101 and the image forming apparatus 102 are known configurations, detailed description of these is omitted here. FIG. 2 is a block diagram showing an electrical system configuration of the image forming system 100 in the present embodiment.

As shown as well in FIG. 1, the image forming system 100 includes the image forming apparatus 102 and the finisher 101. The image forming apparatus 102 includes a CPU (not shown) and a communication port. The finisher 101, too, includes a CPU 110 and a communication port for establishing communication with the image forming apparatus 102. Accordingly, the image forming apparatus 102 and the finisher 101 can communicate with each other through a communication line 130 connected via the communication ports. The finisher 101 acquires mode information on binding, sheet information, and information on the image forming apparatus 102 through this communication line 130, and the image forming apparatus 102 is notified of information from the finisher 101 through the communication line 130.

Signals from various sensors, such as an entrance sensor and a temperature sensor, and various switches are input to the CPU 110; the CPU 110 controls a signal to a motor driver and drives a corresponding sensor such as for sheet conveyance or sheet post-processing on the basis of information of an input signal. The entrance sensor enables the CPU 110 to detect that a sheet has been conveyed to the finisher 101.

The CPU 110 includes a timer unit 113, and can detect a time from the detection of a sheet by the entrance sensor. Furthermore, through the communication line 130, the CPU 110 also can detect that a sheet has been conveyed to the finisher 101. The CPU 110 further includes a control unit and an arithmetic operation unit; the control unit controls the interpretation of a command and the flow of program control, and the arithmetic operation unit carries out an operation. A program is stored in a storage unit 115; the CPU 110 retrieves a command to be executed (a numerical value or a string of numerical values) from a memory where the program has been stored, and executes the program. Incidentally, in the block diagram of FIG. 2, the storage unit 115 exists within the CPU 110; needless to say, the storage unit 115 can be placed outside the CPU 110.

Figure 3A:
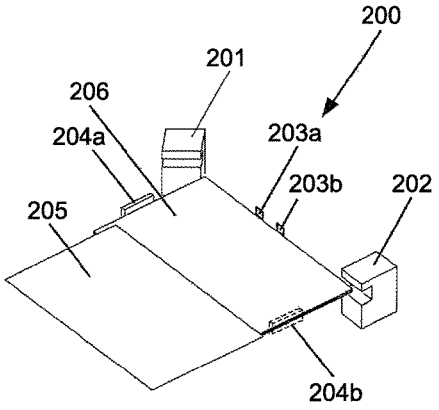
FIG. 3A is a perspective view showing a binding processing unit of a finisher.
Figure 3B:
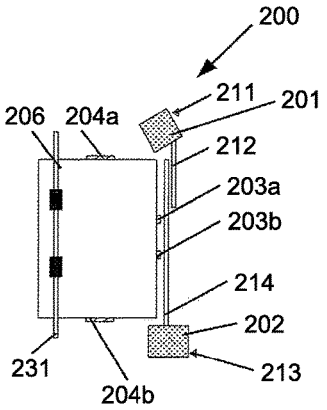
FIG. 3B is a plan view showing the binding processing unit of the finisher.

Incidentally, the CPU 110 controls the driving of conveyance roller 231, jogger fences 204*a* and 204*b*, binding teeth 223, etc. to be described later on the basis of the program. FIG. 3A and FIG. 3B are a diagram showing a binding processing unit 200 of the finisher 101; FIG. 3A is a perspective view, and FIG. 3B is a plan view.

In FIG. 3A and FIG. 3B, the staple-free binding unit 201 is installed on the back side of the finisher 101, and the staple-using binding unit 202 is installed on the front side of the finisher 101. The staple-free binding unit 201 is a binding device having a function of binding a sheet bundle 206 without using staples. The staple-using binding unit 202 is a device having a function of binding a sheet bundle 206 with staples 221.

Sheets 205 are sequentially ejected onto a staple tray (hidden beneath the sheets 205) (not shown) as an accumulation means, and are accumulated into a sheet bundle 206. On the upstream side of the staple tray in the sheet conveying direction (the side of the tail end of sheets), tail-end adjustment stoppers 203*a* and 203*b* are installed. The tail end of a sheet 205 conveyed from the image forming apparatus 102 bumps against the tail-end adjustment stoppers 203*a* and 203*b*, thereby the tail-end adjustment stoppers 203*a* and 203*b* serve as a reference plane for aligning the sheet 205. The tail-end adjustment stoppers 203*a* and 203*b* align the position of sheet(s) 205 or a sheet bundle 206 in the sheet conveying direction.

The jogger fences 204*a* and 204*b* are installed parallel to the staple tray in the sheet conveying direction. The jogger fences 204*a* and 204*b* are alignment plates for aligning a sheet 205 conveyed from the image forming apparatus 102 in a width direction of the sheet 205; both ends of the sheet 205 bump against the jogger fences 204*a* and 204*b*, thereby the sheet 205 is aligned, for example, in the center.

A sheet 205 is a paper sheet that has been conveyed and ejected from the image forming apparatus 102, and, in the present embodiment, is, for example, a sheet as a recording medium. Various types of paper sheets, such as a film sheet and a cardboard sheet, are treated as a sheet.

A sheet bundle 206 is a bundle of aligned sheets 205 conveyed from the image forming apparatus 102. A staple-free binding unit home position sensor 211 detects the position of the staple-free binding unit 201 and sets the detected position as the home position of the staple-free binding unit 201. A staple-free binding unit movement guide rail 212 is a rail that guides the movement of the staple-free binding unit 201 so that the staple-free binding unit 201 can stably move in a sheet width direction. A staple-using binding unit home position sensor 213 detects the position of the staple-using binding unit 202 and sets the detected position as the home position of the staple-using binding unit 202. A staple-using binding unit movement guide rail 214 is a rail that guides the movement of the staple-using binding unit 202 so that the staple-using binding unit 202 can stably move in the sheet width direction. The conveyance roller 231 is a roller that conveys a sheet 205 conveyed from the image forming apparatus 102 to an alignment unit or conveys a sheet bundle 206 having been subjected to a binding process to a sheet ejection unit.

Figure 4A:
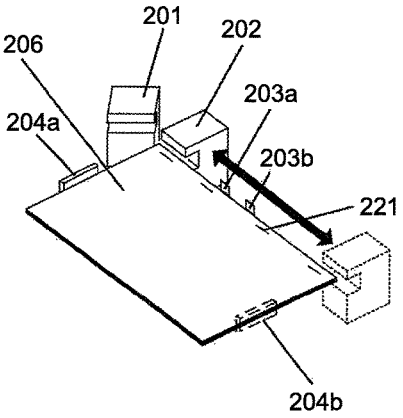
FIG. 4A and FIG. 4B are an explanatory diagram illustrating a staple-using binding process.
Figure 4B:
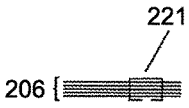

FIG. 4A and FIG. 4B are an explanatory diagram illustrating a staple-using binding process. FIG. 4A is a perspective view showing a relationship between a sheet bundle 206 and the staple-using binding unit 202 and the staple-free binding unit 201, and FIG. 4B is a diagram showing a bound state.

In a process of binding a sheet bundle 206 performed by the staple-using binding unit 202, the staple-using binding unit 202 is guided by the staple-using binding unit movement guide rail 214, and moves along the tail end of sheets as shown in FIG. 4A. Then, predetermined points of the aligned sheet bundle 206 are bound with staples 221. The bound state of the sheet bundle 206 is shown in FIG. 4B. As the binding process of binding a sheet bundle with staples 221 is a known process, detailed description of the process is omitted here.

Figure 5:
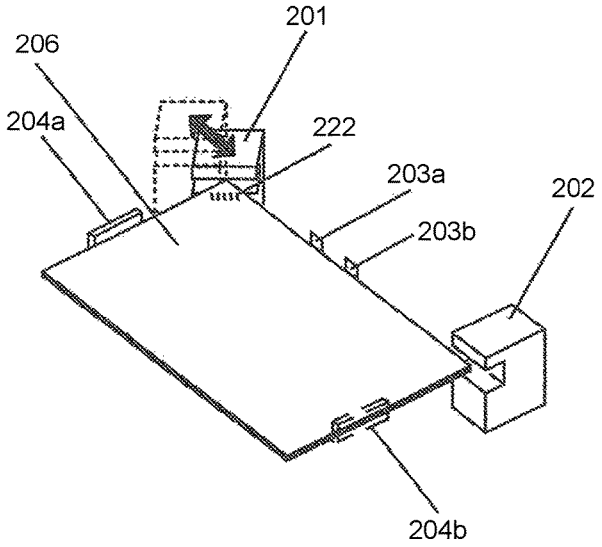
FIG. 5 is an explanatory diagram illustrating a staple-free binding process.
Figure 6:
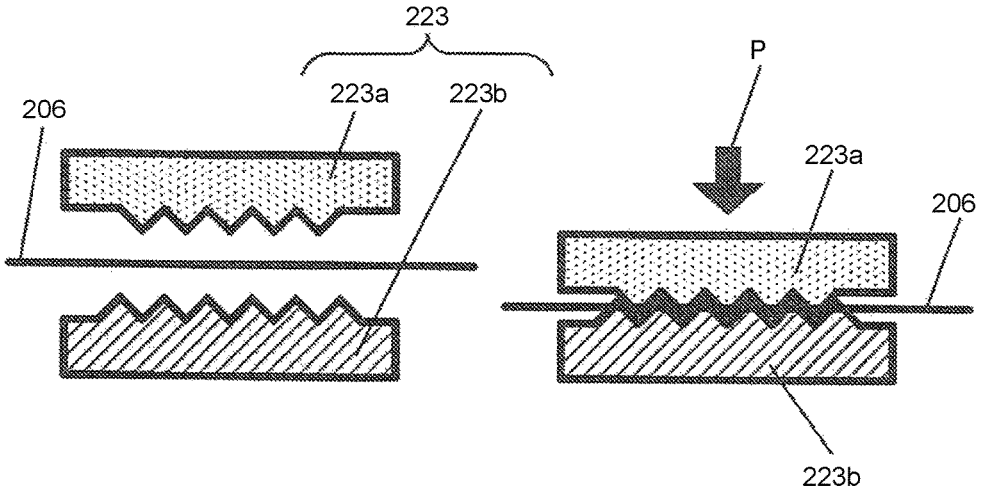
FIG. 6 is an explanatory diagram illustrating a binding operation of a staple-free binding unit.

FIG. 5 is an explanatory diagram illustrating a staple-free binding process, and is a perspective view showing a relationship between a sheet bundle 206 and the staple-using binding unit 202 and the staple-free binding unit 201. FIG. 6 is an explanatory diagram illustrating a binding operation of the staple-free binding unit.

The staple-free binding unit 201 includes binding teeth 223, and moves along the staple-free binding unit movement guide rail 212 in a state where the staple-free binding unit 201 keeps at a distance from the sheet bundle 206 in a direction of arrow in FIG. 5. Then, when the staple-free binding unit 201 has reached the binding position, a pressure P is planarly applied to an upper binding tooth 223*a* and a lower binding tooth 223*b* by a known pressurizing means (not shown), such as a motor-driven pressure lever (see Patent Literature 1), and the upper and lower binding teeth 223*a* and 223*b* crimp the tail end of the aligned sheet bundle 206, thereby forming a binding tooth mark 222. The crimped sheet bundle 206 is bound by entanglement of fibers of the sheets. This entangled state is formed as a binding tooth mark 222 on the sheet bundle 206.

Figure 7A:
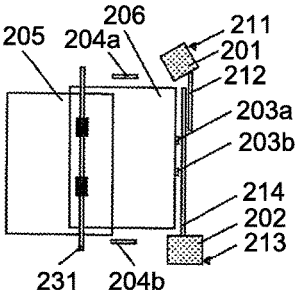
FIG. 7A, FIG. 7B and FIG. 7C are an explanatory diagram illustrating a sheet aligning operation.
Figure 7B:
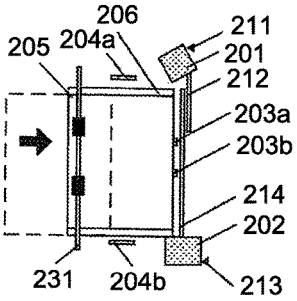
Figure 7C:
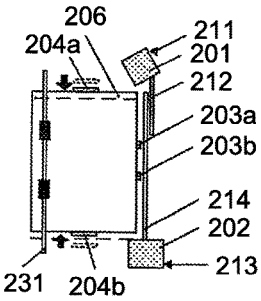

FIG. 7A, FIG. 7B, and FIG. 7C are an explanatory diagram illustrating a sheet aligning operation; FIG. 7A is a diagram showing a state where a sheet is ejected onto the tray, FIG. 7B is a diagram showing an operation when the tail end of the sheet is aligned, and FIG. 7C is a diagram showing an operation when the side end of the sheet is aligned. A sheet 205 that has been conveyed from the image forming apparatus 102 to the finisher 101 and ejected onto the staple tray (not shown) within the finisher 101 is aligned on the staple tray in the sheet conveying direction and a direction perpendicular to the sheet conveying direction. The sheet 205 ejected onto the staple tray can be aligned in the sheet conveying direction in such a manner that the conveyance roller 231 conveys the sheet 205 in a direction opposite to the sheet conveying direction, thereby the sheet 205 bumps against the tail-end adjustment stoppers 203*a* and 203*b* installed on the back end of the staple tray in the sheet conveying direction.

The sheet 205 can be aligned in the direction perpendicular to the sheet conveying direction by driving the pair of jogger fences 204*a* and 204*b* installed on the side of the side end of the sheet 205 after the sheet 205 has bumped against the tail-end adjustment stoppers 203*a* and 203*b*. Accordingly, a new sheet bundle 206 that the sheet 205 has been put on top of a sheet bundle 206 accumulated on the staple tray is formed in a state where the sheets are aligned.

Incidentally, the sheet conveying direction is a so-called sheet length direction, and the direction perpendicular to the sheet conveying direction is a sheet width direction. This completes the alignment of the sheet bundle 206 in the length direction and the width direction.

Figure 8A:
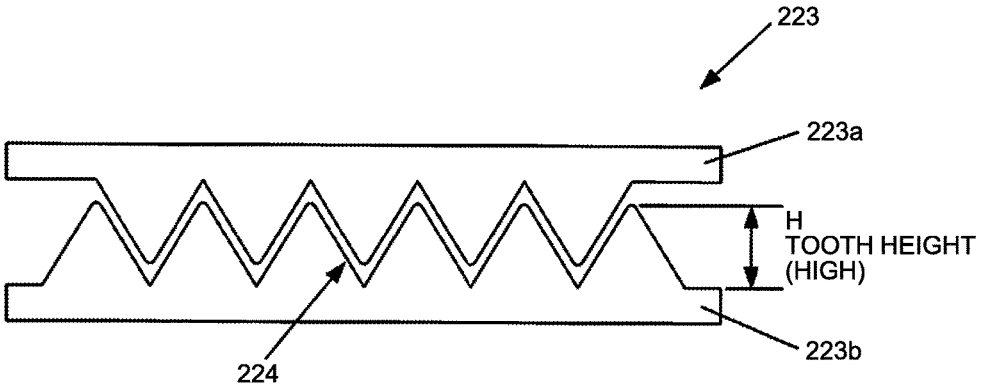
FIG. 8A and FIG. 8B are a diagram showing a state of the engagement of upper and lower binding teeth of the staple-free binding unit.
Figure 8B:
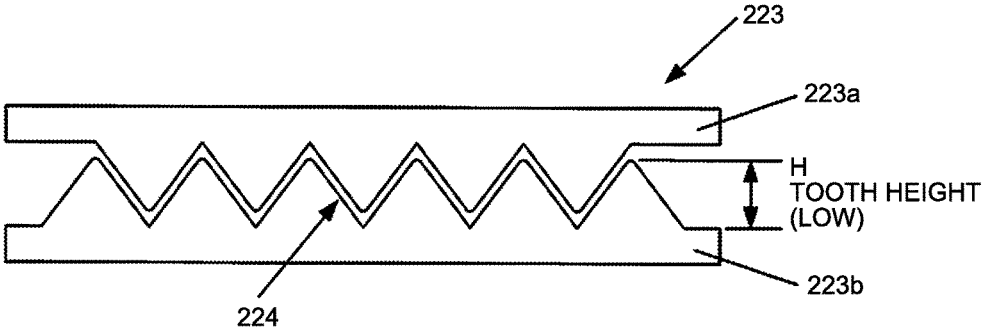
Figure 9:
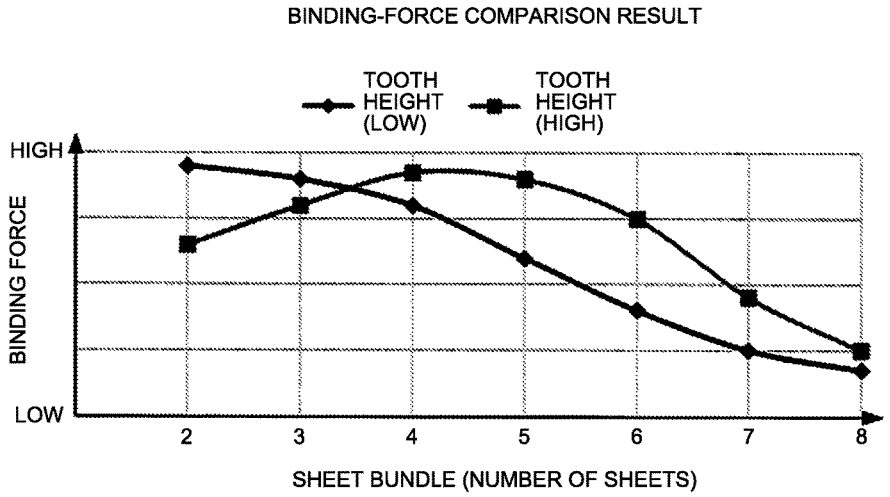
FIG. 9 is a characteristic diagram showing a relationship between the number of a sheet bundle and the binding force according to the tooth height of the staple-free binding unit.

FIG. 8A and FIG. 8B are a diagram showing a state of the engagement of the upper and lower binding teeth 223*a* and 223*b* of the staple-free binding unit 201; FIG. 8A shows a state of the engagement of the binding teeth 223 having high tooth height H, and FIG. 8B shows a state of the engagement of the binding teeth 223 having low tooth height H. FIG. 9 is a characteristic diagram showing a relationship between the number of a sheet bundle 206 and the binding force according to the tooth height H of the staple-free binding unit 201 shown in FIG. 8A and FIG. 8B. In FIG. 9, the horizontal axis indicates the number of a sheet bundle 206, and the vertical axis indicates the binding force.

From FIG. 9, it can be seen that the tooth height H causing the high binding force on a sheet bundle 206 differs between when the number of the sheet bundle 206 is small and when the number of the sheet bundle 206 is large. In the example shown in FIG. 9, the binding teeth 223 having high tooth height H exert the highest binding force when the number of the sheet bundle 206 is four to five, and the binding teeth 223 having low tooth height H exert the highest binding force when the number of the sheet bundle 206 is two to three. From such characteristics, it turns out that when a sheet bundle 206 is bound by crimp binding, the averaged binding force can be obtained by performing a binding process by changing the tooth height H according to the number of a sheet bundle 206. Accordingly, by using binding teeth 223 of the optimum height for the number of a sheet bundle 206, a certain or higher binding force can be secured regardless of the number of the sheet bundle 206.

However, configuring one staple-free binding unit 201 to hold multiple types of binding teeth 223 causes an increase in size and an increase in cost.

Figure 10A:
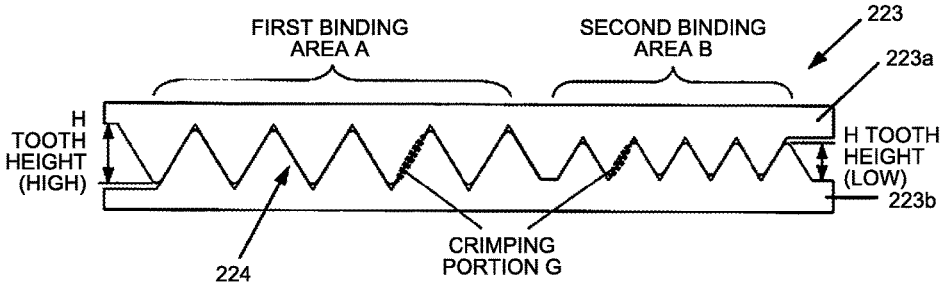
FIG. 10A and FIG. 10B are a diagram showing binding teeth having a combination of different tooth heights.
Figure 10B:
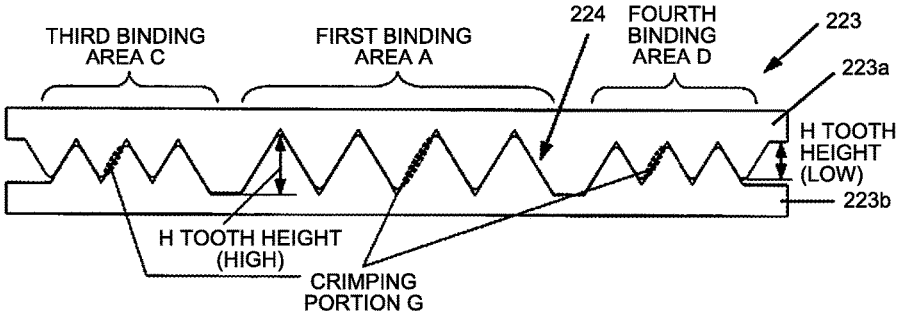

Therefore, in the present embodiment, the upper and lower binding teeth 223*a* and 223*b* are configured to each have areas that differ in tooth height H and be able to engage with each other. FIG. 10A and FIG. 10B are a diagram showing the binding teeth 223 having a combination of different tooth heights H. FIG. 10A shows an example where a first binding area A having high tooth height H and a second binding area B having low tooth height H are arranged side by side; FIG. 10B shows an example where a first binding area A having high tooth height H is arranged in the center, and third and fourth binding areas C and D having low tooth height H are arranged on the both sides of the first binding area A.

When the first binding area A having high tooth height H and the second binding area B having low tooth height H are arranged side by side as shown in FIG. 10A, the binding teeth 223 are configured so that crimping portions G of the first and second binding areas A and B come in contact when the binding teeth 223 are pressed against each other so as to make the engagement of the upper and lower binding teeth 223*a* and 223*b* when a sheet bundle 206 is bound constant.

On the other hand, when the first binding area A having high tooth height H is arranged in the center of the binding teeth 223 and the third and fourth binding areas C and D having low tooth height H are arranged on the both sides of the first binding area A as shown in FIG. 10B, the third and fourth binding areas C and D have the same tooth height H. Then, the dimensions of the third and fourth binding areas C and D in the length direction are set so that the third and fourth binding areas C and D together can obtain the same effect as the second binding area B in FIG. 10A. Incidentally, also in the configuration of the binding teeth shown in FIG. 10B, just like the configuration of the binding teeth shown in FIG. 10A, the binding teeth 223 are configured so that crimping portions G of the first, third, and fourth binding areas A, C, and D come in contact when the binding teeth 223 are pressed against each other.

As shown in FIG. 10A and FIG. 10B, the area having high tooth height H (the first binding area A) and the area having low tooth height H (the second binding area B or the third and fourth binding areas C and D) are formed on each of the upper and lower binding teeth 223*a* and 223*b*, and the upper and lower binding teeth 223*a* and 223*b* compose a pair of binding teeth 223; therefore, when the number of sheets to be bound is large, binding tooth marks 222 formed by rugged portions of the first binding area A having high tooth height H can bind a sheet bundle 206 at high binding force. On the other hand, when the number of sheets to be bound is small, binding tooth marks 222 formed by rugged portions of the second binding area B or the third and fourth binding areas C and D having high tooth height H can bind (entangle) a sheet bundle 206 at high binding force.

That is, one pair of binding teeth 223 is composed of a combination of a portion having high tooth height H and a portion having low tooth height H, thereby without having to change the configuration of the staple-free binding unit 201, a sheet bundle 206 can be bound regardless of the number of sheets to be bound.

Furthermore, there are two binding areas having different tooth heights H; therefore, a sheet bundle 206 of more sheets than ever before can be bound by adjusting the applicable number of sheets corresponding to each tooth height H. For example, if one rugged shape used to deal with binding of two to five sheets so far, by optimizing the rugged shape of binding teeth of a staple-free binding unit so that a rugged portion having low tooth height H can deal with binding of two to four sheets and a rugged portion having high tooth height H can deal with binding of four to six sheets, the staple-free binding unit can effectively bind a sheet bundle 206 of two to up to six sheets. Incidentally, three or more binding areas having different tooth heights can be formed on one pair of binding teeth 223.

Furthermore, the relationship between the tooth height H and the binding force as shown in FIG. 9 can be obtained according to not only the number of sheets but also the types of sheets such as the thickness of the sheets, material of the sheets, and the flexibility. Accordingly, as for the types of sheets, a relationship between the tooth height H and the binding force can be obtained as in the case of the number of sheets, and areas of high and low tooth heights H can be set so that one pair of binding teeth 223 can deal with multiple types of sheets.

Figure 11A:
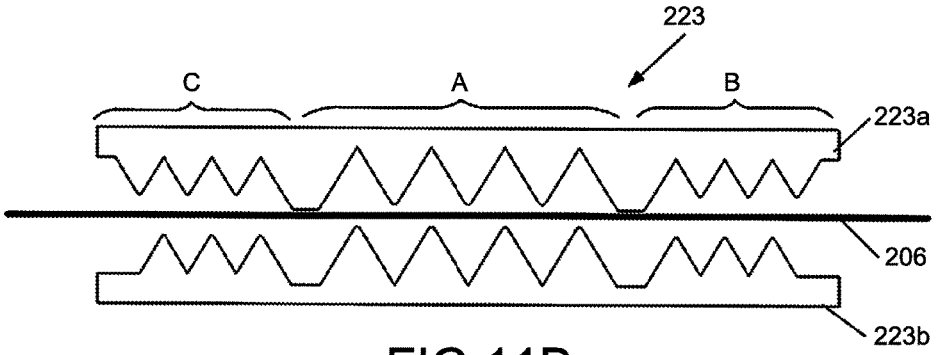
FIG. 11A, FIG. 11B, and FIG. 11 C are an explanatory diagram illustrating a binding operation when a sheet bundle is crimp-bound by using binding teeth provided with three binding areas.
Figure 11B:
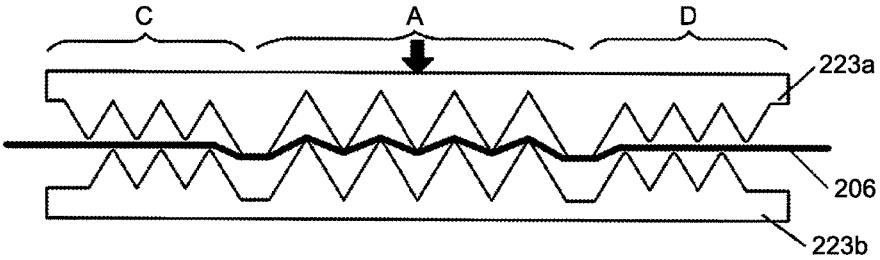
Figure 11C:
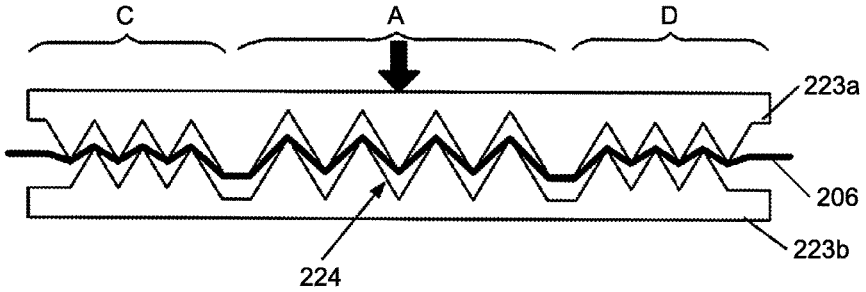

FIG. 11A, FIG. 11B, and FIG. 11C are an explanatory diagram illustrating a binding operation when a sheet bundle 206 is crimp-bound by using the binding teeth 223 shown in FIG. 10B. In FIG. 11A, FIG. 11B, and FIG. 11C, a sheet bundle 206 is bound by a configuration in which the first binding area A having high tooth height H is arranged in the center of the binding teeth 223, and the third and fourth binding areas C and D having low tooth height H are arranged on the both sides of the first binding area A.

In the case where a rugged portion having high tooth height H is arranged in the center of each of the upper and lower binding teeth 223*a* and 223*b*, and rugged portions having low tooth height H are arranged on the both sides of the high tooth portion as shown in FIG. 11A, FIG. 11B, and FIG. 11C, when the crimping operation is started from the initial state shown in FIG. 11A, as shown in FIG. 11B, the first binding area A having high tooth height H in the center first comes in contact with the sheet bundle 206, and a binding process is performed. At this time, rugged portions of the third and fourth binding areas C and D having low tooth height H are on the both sides of the first binding area A have not yet reached the sheet bundle 206, so the rugged portions of the first binding area A having high tooth height H can bite the sheet bundle 206 while bending the sheet bundle 206.

When the upper and lower binding teeth 223*a* and 223*b* are further brought closer to each other, the third and fourth binding areas C and D having low tooth height H also start binding the sheet bundle 206. At this time, the both outer sides of the third and fourth binding areas C and D of the binding teeth 223 do not restrain the sheet bundle 206, so the third and fourth binding areas C and D can bite the sheet bundle 206 while bending the sheet bundle 206.

If, the other way around, a rugged portion having low tooth height H is arranged in the center and rugged portions having high tooth height H are arranged on the both sides of the low-tooth rugged portion, the high-tooth rugged portions on the both sides of the low-tooth rugged portion first start biting a sheet bundle 206, and restrain the sheet bundle 206. After that, a binding process goes on, and, when the low-tooth rugged portion in the center has started biting the sheet bundle 206, the sheet bundle 206 cannot be bent, so the sheet bundle 206 are broken. Therefore, it is necessary to install the high-tooth rugged portion in the center of the binding teeth 223 as shown in FIG. 10(*b*)

As explained above, according to the present embodiment, the following advantageous effects can be achieved. Incidentally, in the following description, a component in claims correspond to a unit in the present embodiment, and, if the term is different, the latter is parenthesized.

(1) The pair of binding teeth 223 applies pressure to a sheet bundle 206 thereby crimp-binding the sheet bundle 206. The binding teeth 223 includes a binding unit 224 that has two or more binding areas which differ in tooth height H (the first to fourth binding areas A to D) and crimping portions G thereof come in contact when the binding teeth 223 are pressed against each other in the binding areas. Accordingly, there is no need to install a mechanism of switching between the binding teeth according to the number of a sheet bundle 206. Therefore, it is possible to reduce the device size and conserve space. Furthermore, these can reduce cost. Moreover, it is possible to secure relatively uniform binding force regardless of the number of sheets to be bound and enough binding force to maintain the binding force.

(2) In the above paragraph (1), the tooth heights H of the two or more binding areas (the first to fourth binding areas A to D) are set to deal with a different number of a sheet bundle to be bound; therefore, an optimum bindable sheet number can be adjusted for each of the binding areas (A to D) which differ in tooth height H, and a certain or higher binding force can be secured regardless of the number of sheets to be bound. Furthermore, it is possible to increase the bindable sheet number.

(3) In the above paragraph (1), the tooth heights H of the two or more binding areas (the first to fourth binding areas A to D) are set according to the type of sheets to be bound; therefore, one pair of binding teeth 223 can perform an appropriate binding process on multiple types of sheets, and can increase the number of bindable sheet types and deal with the diversification of the sheet types in a binding process.

(4) In the above paragraphs (1) to (3), the tooth height H of, of the two or more binding areas (A to D), the first binding area A located in the center is higher than the tooth height of the second and third binding areas arranged (the third and fourth binding areas C and D) on the both sides of the first binding area A; therefore, the deformation of a sheet bundle caused when the sheet bundle is bound is about the same on the both sides of a binding tooth mark 222, and it is possible to guarantee beautiful binding of the sheet bundle without twists of the sheet bundle 206 in or around the binding tooth mark 222 and misalignment of the sheet bundle 206.

(5) In the above paragraphs (1) to (4), the pair of binding teeth 223 is arranged to be opposed to each other, and is planarly applied with pressure by a pressurizing unit; therefore, it is possible to perform staple-free binding with a simple mechanism.

(6) A sheet processing device (the finisher 101) includes a conveying unit (the conveyance roller 231) that conveys a sheet 205, an accumulating unit (the staple tray) that accumulates thereon the sheet 205 conveyed by the conveying unit (the conveyance roller 231), an aligning unit (the tail-end adjustment stoppers 203*a* and 203*b* and the jogger fences 204*a* and 204*b*) that aligns the end of the sheet 205 accumulated on the accumulating unit (the staple tray), the binding teeth 223 according to any one of claims 1 to 5, and a pressurizing unit that holds a sheet bundle 206 aligned by the aligning unit (the tail-end adjustment stoppers 203*a* and 203*b* and the jogger fences 204*a* and 204*b*) between the binding teeth 223 and binds the sheet bundle by applying pressure P in a direction of bringing the pair of binding teeth 223 closer to each other; therefore, it is possible to provide the sheet processing device (the finisher 101) that can achieve the effects described in the paragraph (1).

(7) The image forming apparatus 102 includes a conveying unit (the conveyance roller 231) that conveys a sheet 205, an accumulating unit (the staple tray) that accumulates thereon the sheet 205 conveyed by the conveying unit (the conveyance roller 231), an aligning unit (the tail-end adjustment stoppers 203*a* and 203*b* and the jogger fences 204*a* and 204*b*) that aligns the end of the sheet 205 accumulated on the accumulating unit (the staple tray), the binding teeth 223, and a pressurizing unit that holds a sheet bundle 206 aligned by the aligning unit (the tail-end adjustment stoppers 203*a* and 203*b* and the jogger fences 204*a* and 204*b*) between the binding teeth 223 and binds the sheet bundle by applying pressure P in a direction of bringing the pair of binding teeth 223 closer to each other; therefore, it is possible to provide the image forming apparatus 102 that can achieve the effects described in the paragraph (1).

(8) The image forming system 100 includes the image forming apparatus 102 including an image forming unit that forms an image on a sheet 205, and the sheet processing device (the finisher 101) according to the paragraph (6) that performs a preset process on the sheet 205 conveyed from the image forming apparatus 102; therefore, it is possible to provide the image forming system 100 that can achieve the effects described in the paragraph (1).

(9) A sheet binding method includes relatively positioning a sheet bundle 206 between the pair of binding teeth 223 including the binding unit 224 that has two or more binding areas which differ in tooth height H (the first to fourth binding areas A to D) and crimping portions G thereof come in contact when the binding teeth 223 are pressed against each other in the binding areas, applying pressure P in a direction of bringing the pair of binding teeth 223 closer to each other in a state where the sheet bundle 206 is placed between the pair of binding teeth 223, and binding the sheet bundle by pressing the sheet bundle 206 firmly between the binding teeth; therefore, it is possible to provide the sheet binding method that can achieve the effects described in the paragraph (1).

According to the present embodiments, it is possible to secure constant binding force without causing an increase in device size and regardless of the number of sheets to be bound.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

What is claimed is:

1. An apparatus, comprising:

a binding unit configured to apply pressure to a sheet bundle to crimp-bind the sheet bundle, the binding unit comprising:

a first planar member comprising a first plurality of binding teeth organized in a first continuous row; and a second planar member comprising a second plurality of binding teeth organized in a second continuous row that are configured to engage with the first plurality of binding teeth to apply the pressure to the sheet bundle, wherein the first plurality of binding teeth and the second plurality of binding teeth each have a first height within a first binding area of the first continuous row and the second continuous row, wherein the first plurality of binding teeth and the second plurality of binding teeth each have a second height within a second binding area of the first continuous row and the second continuous row, wherein the first height in the first binding area is different than the second height in the second binding area, wherein the first planar member and the second planar member move toward each other and contact the sheet bundle to crimp-bind the sheet bundle, wherein the first binding area and the second binding area are arranged side-by-side in a length direction of the binding unit in which the first continuous row of the first plurality of binding teeth and the second continuous row of the second plurality of binding teeth are arranged, wherein the first plurality of binding teeth and the second plurality of binding teeth, collectively forming the first binding area and the second binding area, engage with each other such that the first binding area and the second binding area independently operate to crimp-bind the sheet bundle.

2. The apparatus of claim 1, wherein:

the first binding area generates a first binding force which varies based on a number of sheets in the sheet bundle, and the second binding area generates a second binding force which varies based on the number of sheets in the sheet bundle, wherein the first binding force and the second binding force are different.

3. The apparatus of claim 2, wherein:

the first height in the first binding area is greater than the second height in the second binding area, and the first binding force is less than the second binding force when the number of sheets in the sheet bundle is less than a threshold.

4. The apparatus of claim 3, wherein the first binding force is greater than the second binding force when the number of sheets in the sheet bundle is greater than the threshold.

5. The apparatus of claim 1, wherein:

the first binding area is disposed proximate to a center of the first continuous row and the second continuous row, and the second binding area is arranged on sides of the first binding area distal to the center.

6. The apparatus of claim 5, wherein:

the first height of the first binding area is greater than the second height of the second binding area.

7. The apparatus of claim 1, further comprising:

a sheet processing device, comprising:

a conveying unit configured to convey a sheet of the sheet bundle;

an accumulating unit configured to accumulate thereon the sheet conveyed by the conveying unit;

an aligning unit that aligns an end of the sheet accumulated on the accumulating unit;

the binding unit; and a pressurizing unit configured to hold the sheet bundle aligned by the aligning unit between the first planar member and the second planar member of the binding unit by applying pressure to engage the first plurality of binding teeth with the second plurality of binding teeth as the first planar member moves toward the second planar member.

8. The apparatus of claim 7, further comprising:

an image forming apparatus, comprising:

the sheet processing device.

9. The apparatus of claim 8, wherein:

the image forming apparatus further comprises:

an image forming unit configured to form an image on the sheet, and the sheet processing device performs a preset process on the sheet conveyed from the image forming apparatus.

10. A method of operating a binding unit to apply pressure to a sheet bundle to crimp-bind the sheet bundle, the binding unit comprising a first planar member comprising a first plurality of binding teeth organized in a first continuous row, a second planar member comprising a second plurality of binding teeth organized in a second continuous row that are configured to engage with the first plurality of binding teeth to apply the pressure to the sheet bundle, wherein the first plurality of binding teeth and the second plurality of binding teeth each have a first height within a first binding area of the first continuous row and the second continuous row, wherein the first plurality of binding teeth and the second plurality of binding teeth each have a second height within a second binding area of the first continuous row and the second continuous row, wherein the first height in the first binding area is different than the second height in the second binding area, wherein the first planar member and the second planar member move toward each other and contact the sheet bundle to crimp-bind the sheet bundle, wherein the first binding area and the second binding area are arranged side-by-side in a length direction of the binding unit in which the first continuous row of the first plurality of binding teeth and the second continuous row of the second plurality of binding teeth are arranged, the method comprising:

positioning the sheet bundle between the first planar member and the second planar member;

applying the pressure to the sheet bundle by engaging the second plurality of binding teeth with the first plurality of binding teeth, wherein the first plurality of binding teeth and the second plurality of binding teeth, collectively forming the first binding area and the second binding area, engage with each other such that the first binding area and the second binding area independently operate to crimp-bind the sheet bundle; and crimp-binding the sheet bundle utilizing the pressure applied to the sheet bundle by the binding unit.

11. An apparatus, comprising:

a binding unit configured to apply pressure to a sheet bundle to crimp-bind the sheet bundle, the binding unit comprising:

a first planar member comprising a first plurality of binding teeth organized in a first continuous row; and a second planar member comprising a second plurality of binding teeth organized in a second continuous row that are configured to engage with the first plurality of binding teeth to apply the pressure to the sheet bundle, wherein a first crimping portion between the first plurality of binding teeth and the second plurality of binding teeth is formed within a first binding area of the first continuous row and the second continuous row, wherein a second crimping portion between the first plurality of binding teeth and the second plurality of binding teeth is formed within a second binding area of the first continuous row and the second continuous row, wherein a height of the first crimping portion in the first binding area is different than a height of the second crimping portion in the second binding area, wherein the first planar member and the second planar member move toward each other and contact the sheet bundle to crimp-bind the sheet bundle, wherein the first binding area and the second binding area are arranged side-by-side in a length direction of the binding unit in which the first continuous row of the first plurality of binding teeth and the second continuous row of the second plurality of binding teeth are arranged, wherein the first plurality of binding teeth and the second plurality of binding teeth, collectively forming the first binding area and the second binding area, engage with each other such that the first binding area and the second binding area independently operate to crimp-bind the sheet bundle.

* * * * *